US009458646B2

(12) United States Patent
Maguire

(10) Patent No.: US 9,458,646 B2
(45) Date of Patent: Oct. 4, 2016

(54) HANDLE AND LOCKING MECHANISM

(76) Inventor: Cary Maguire, Chicago, IL (US)

( * ) Notice: Subject to any disclaimer, the term of this patent is extended or adjusted under 35 U.S.C. 154(b) by 65 days.

(21) Appl. No.: 13/394,933

(22) PCT Filed: Sep. 8, 2010

(86) PCT No.: PCT/US2010/048106

§ 371 (c)(1),
(2), (4) Date: Mar. 8, 2012

(87) PCT Pub. No.: WO2011/031742

PCT Pub. Date: Mar. 17, 2011

(65) Prior Publication Data

US 2012/0169072 A1 Jul. 5, 2012

Related U.S. Application Data

(60) Provisional application No. 61/240,330, filed on Sep. 8, 2009.

(51) Int. Cl.

| | |
|---|---|
| ***E05B 3/00*** | (2006.01) |
| ***E05B 1/00*** | (2006.01) |
| ***E05B 41/00*** | (2006.01) |
| ***E05B 47/02*** | (2006.01) |
| ***E05B 65/02*** | (2006.01) |
| ***E05C 3/10*** | (2006.01) |
| ***G07C 9/00*** | (2006.01) |
| *E05B 17/10* | (2006.01) |
| *E05B 47/00* | (2006.01) |

(52) U.S. Cl.

CPC ..... *E05B 1/0038* (2013.01); *E05B 41/00* (2013.01); *E05B 47/02* (2013.01); *E05B 65/025* (2013.01); *E05C 3/10* (2013.01); *G07C 9/00912* (2013.01); *E05B 17/10* (2013.01); *E05B 47/0009* (2013.01); *Y10T 292/57* (2015.04)

(58) Field of Classification Search

CPC .. E05B 85/16; E05B 63/0056; E05B 1/0038; E05B 41/00; E05B 47/02; E05B 65/025; E05B 17/10; E05B 47/0009; E05C 5/00; E05C 3/10; G07C 9/00912; Y10T 292/57

USPC ..... 292/336.3, 65, 31, 1, 194, 195, 199, 292/280; 70/190

See application file for complete search history.

(56) References Cited

U.S. PATENT DOCUMENTS

| | | | | |
|---|---|---|---|---|
| 3,438,227 | A | 4/1969 | Wolniak | |
| 4,099,757 | A * | 7/1978 | Palmer | E05B 65/00 292/126 |

(Continued)

*Primary Examiner* — Kristina Fulton
*Assistant Examiner* — Nathan Cumar
(74) *Attorney, Agent, or Firm* — Kartsounes Law, LLC

(57) ABSTRACT

The present invention generally relates to a handle for a door having a body mountable to a surface of the door, a slide member configured to be received at least partially within the body so as to slidingly move between a first position wherein the slide member projects beyond the body and a second position wherein the slide member is substantially retracted into the body, a fastening member mounted within the body so as to receive at least a portion of the slide member when the slide member is in the second position so as to lock the slide member in the second position, and a locking mechanism configured to prevent opening of the door when the sliding member is in the second position, wherein sliding movement of the slide member from said first position to said second position engages the locking mechanism to prevent opening of the door.

4 Claims, 12 Drawing Sheets

(56) References Cited

U.S. PATENT DOCUMENTS 4,597,599 A * 7/1986 Bisbing ..... E05B 15/025 292/174
4,993,247 A 2/1991 Minemura
5,452,596 A 9/1995 Yamada
6,077,011 A * 6/2000 Walker ..... 411/348
6,149,213 A * 11/2000 Sokurenko et al. ..... 292/340
6,155,616 A * 12/2000 Akright ..... E05B 5/00 292/198
7,473,223 B2 * 1/2009 Fetzer ..... 292/199
2002/0060456 A1 * 5/2002 Linares ..... E05C 3/145 292/103
2007/0029819 A1 * 2/2007 Kitzis ..... B65F 1/1615 292/304
2008/0127684 A1 * 6/2008 Rudduck et al. ..... 70/77
2010/0187837 A1 * 7/2010 Danner et al. ..... 292/164
2010/0237637 A1 * 9/2010 Camp ..... 292/358
2011/0101712 A1 * 5/2011 LaConte ..... 292/252

* cited by examiner

HANDLE AND LOCKING MECHANISM

This application is a National Stage Entry of International Patent Application Number PCT/US10/48106 filed on Sep. 8, 2010 entitled "Handle and Locking Mechanism" which claims priority from U.S. Provisional Application 61/240,330 filed on Sep. 8, 2009 also entitled "Handle and Locking Mechanism".

FIELD OF INVENTION

This invention relates to a handle for a door or the like, and in particular, to a handle for preventing unauthorised access to an enclosure via a door.

BACKGROUND ART

A variety of locking mechanisms exist for preventing unauthorised access to an enclosure such as a room, locker, cabinet and the like. Typically, such locking mechanisms employ a mechanical locking means that secures a door in position within an access space to the enclosure, with the locking mechanism being activated and deactivated by a key or the like, which is typically carried by an authorised person(s).

Such keys have traditionally been in the form of a mechanical key that is shaped to be inserted into an appropriate keyhole formed in the door that is turned to activate/deactivate the locking mechanism. More recently, the use of keypads and other electrical identification means, have removed the need for mechanical keys to be carried by authorised persons to activate the enclosure, as authorised persons have typically been able to enter a password or code into an associated keypad to access the enclosure.

Traditionally, the locking mechanism is often provided separately to the door handle. The door handle has thus traditionally been a relatively passive device that merely provides a gripping means for a user to open the door. Hence, it has often been necessary to separately activate/deactivate the locking mechanism after/before the door has been closed/opened. Whilst such arrangements have proven effective where there is sufficient space on the door to accommodate a handle and a locking means, in many cabinets and the like, such as switchgear cabinets used in switching distribution centres such as telephone exchanges, there is limited space available and as such there is a need to provide a simple system that can function as both a locking mechanism and a handle to permit access of the cabinet only to authorised individuals.

The above references to and descriptions of prior proposals or products are not intended to be, and are not to be construed as, statements or admissions of common general knowledge in the art. In particular, the above prior art discussion does not relate to what is commonly or well known by the person skilled in the art, but assists in the understanding of the inventive step of the present invention of which the identification of pertinent prior art proposals is but one part.

STATEMENT OF INVENTION

Accordingly, in one aspect of the invention there is provided a handle for a door comprising:

a body mountable to a surface of the door;

a slide member configured to be received at least partially within said body so as to slidingly move between a first position wherein the slide member projects beyond the body and a second position wherein the slide member is substantially retracted into said body;

a fastening member mounted within said body so as to receive at least a portion of said slide member when the slide member is in the second position so as to lock said slide member in the second position; and a locking mechanism configured to prevent opening of the door when said sliding member is in the second position, wherein sliding movement of said slide member from said first position to said second position engages the locking mechanism to prevent opening of the door.

In one embodiment, the slide member comprises a stud portion that is received within an aperture of the fastening member when the slide member is in the second position. The fastening member may have a shuttle that is rotatable to engage with a locking groove of the stud portion to lock the slide member in the second position. The shuttle may be rotatable by material adapted to contract when activated.

The locking mechanism may comprise a rack attached to the slide member in engagement with a pinion attached to the body such that sliding movement of the slide member between the first and second position causes rotational movement of the pinion. The pinion may be mounted on a shaft such that rotational movement of the pinion causes the shaft to rotate. A locking tab may be mounted on the shaft, the locking tab being configured to engage with a door jamb when the slide member is in the second position to prevent opening of the door.

BRIEF DESCRIPTION OF THE DRAWINGS

The invention may be better understood from the following non-limiting description of preferred embodiments, in which.

DETAILED DESCRIPTION OF THE DRAWINGS

Preferred features of the present invention will now be described with particular reference to the accompanying drawings. However, it is to be understood that the features illustrated in and described with reference to the drawings are not to be construed as limiting on the scope of the invention.

The present invention will be described below in relation to its application for use with a cabinet, locker or similar storage installation to provide authorised access thereto. However, it will be appreciated that the present invention may equally be employed in a variety of alternative applications, including, data centre cabinets, kitchen cabinets, medicine cabinets, access panels, security doors and standard doorways and the like to provide a locking feature thereto and still fall within the spirit of the present invention.

Figure 1:
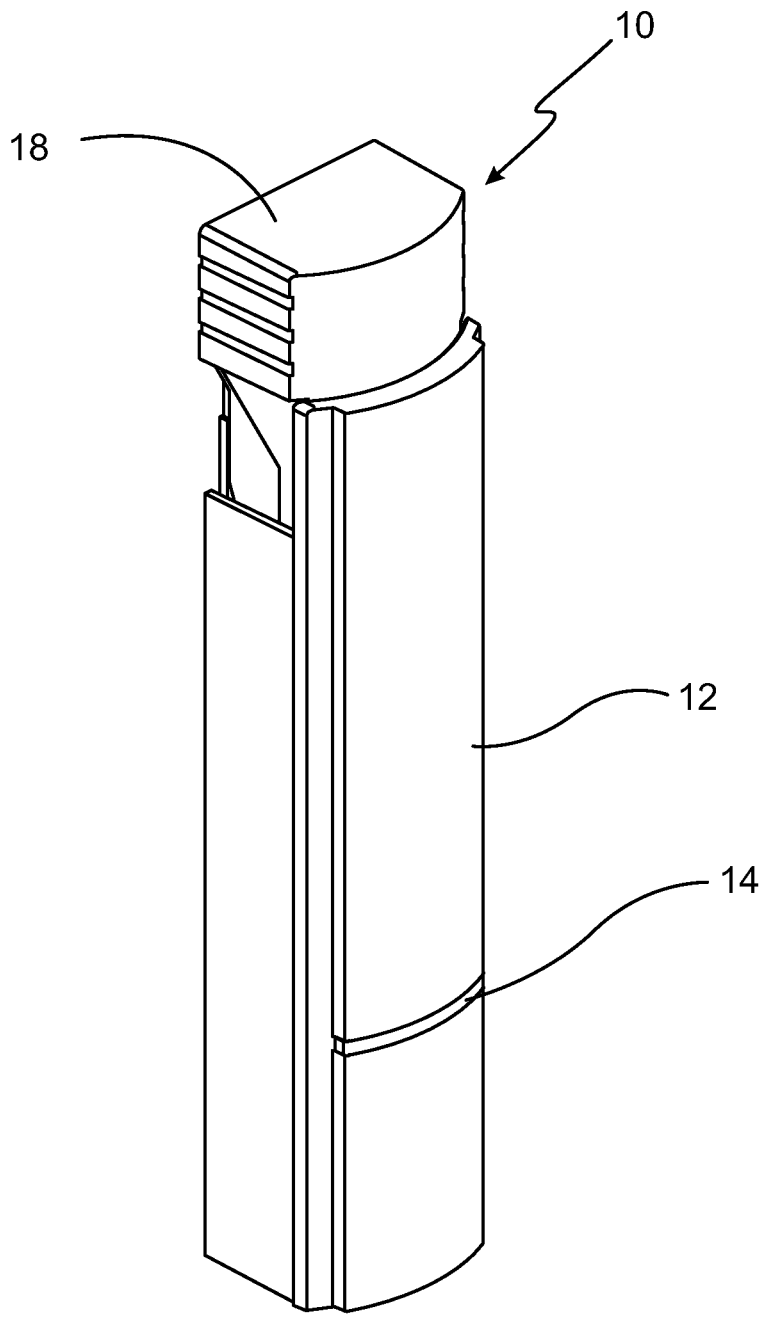
FIG. 1 is perspective view of a locking handle in an open position according to one embodiment of the present invention.
Figure 2:
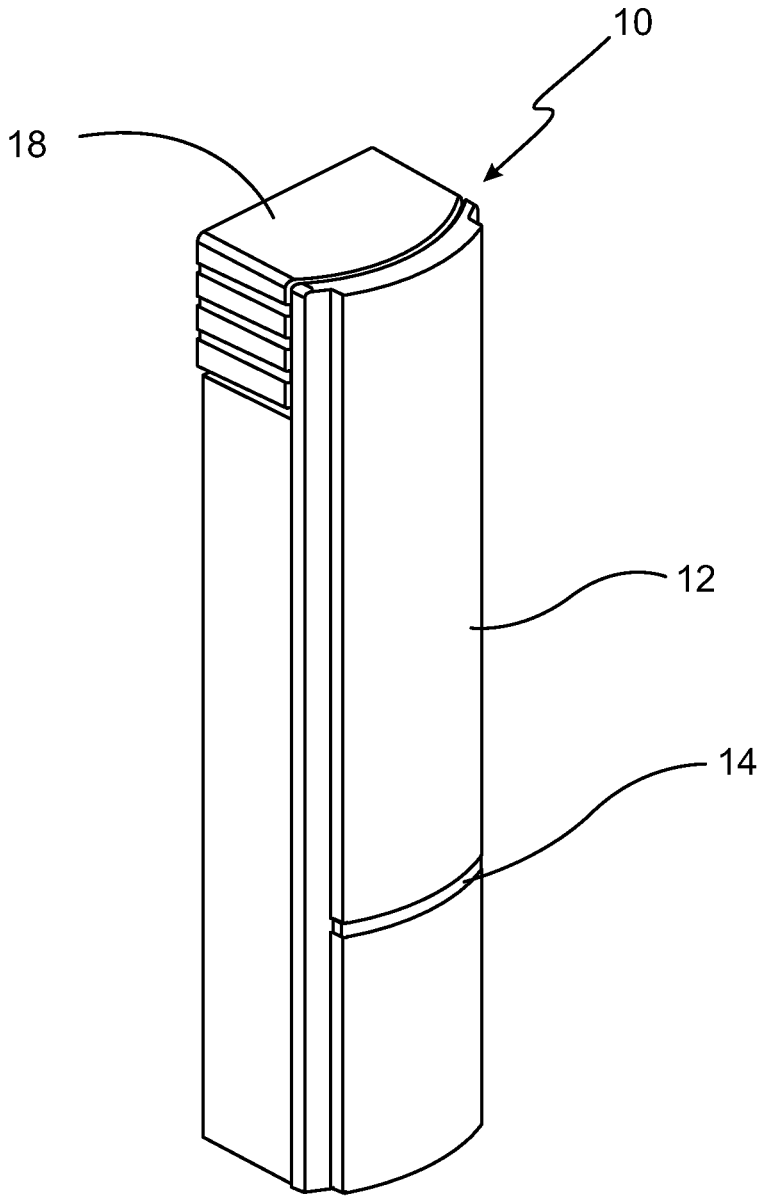
FIG. 2 is a perspective view of the locking handle of FIG. 1 in a closed position.
Figure 3:
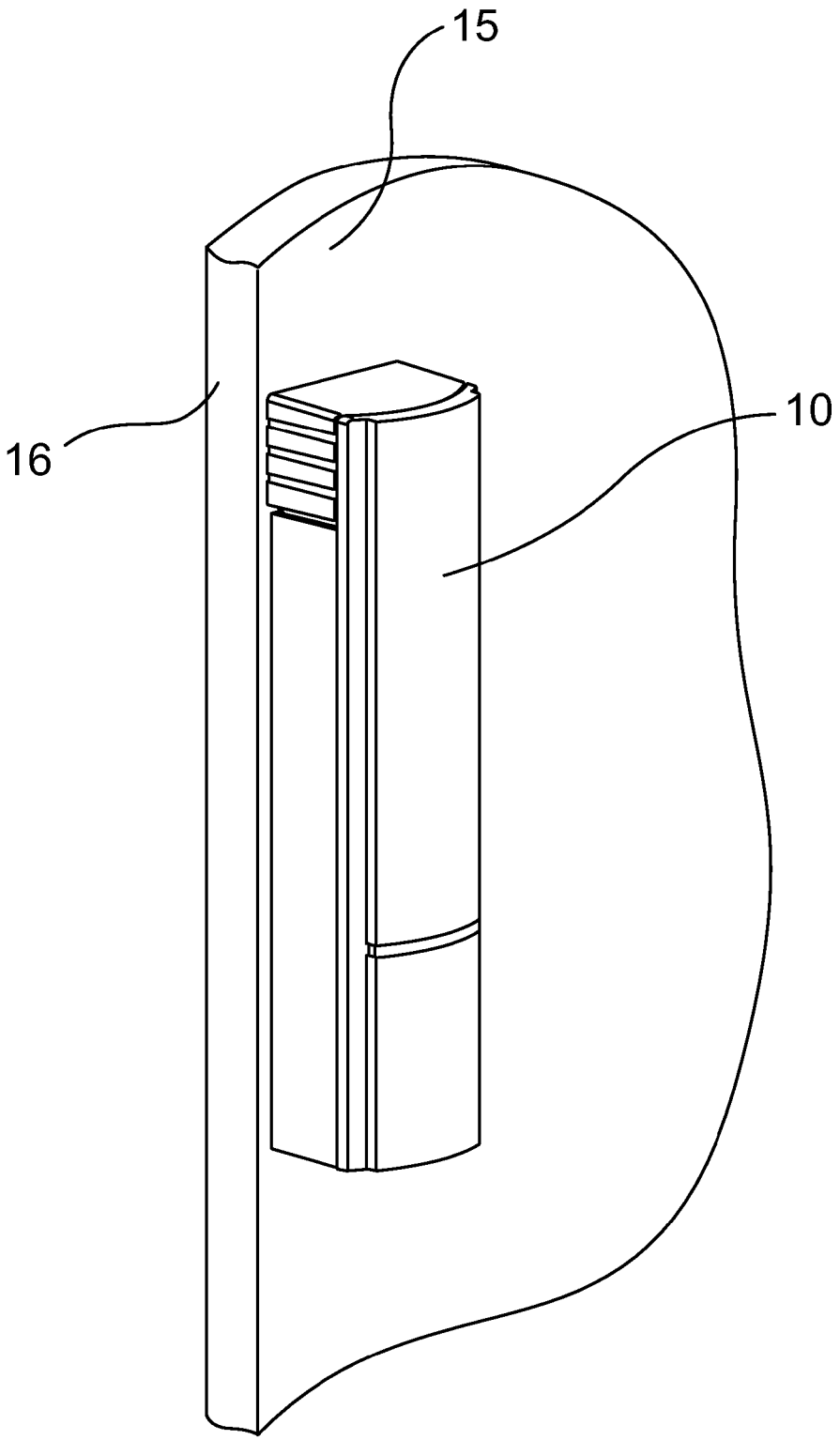
FIG. 3 is a perspective view of the locking handle of FIGS. 1 and 2 mounted on a door for use.

Referring to FIGS. 1-3, one embodiment of the locking handle 10 of the present invention is shown. The locking handle 10 comprises a main body 12 that is configured to be attached to a surface of the door 15. The main body 12 is preferably mounted to the door 15 adjacent an edge 16 thereof to perform a locking function in a manner to be described in more detail below.

A slide member 18 is received within an open end of the main body 12 such that it is free to move in a reciprocating motion therein. In the embodiment as shown, the locking handle 10 is orientated such that the slide member 18 is received in an open top of the main body 12. However, it will be appreciated that the handle 10 may assume a variety of orientations and still fall within the spirit of the present invention. The slide member 18 is movable between an open position as is shown in FIG. 1, wherein the slide member 18 projects beyond the upper extremity of the main body 12, and a closed position as is shown in FIG. 2, wherein the slide member 18 is retracted into the main body 12. As will be discussed in more detail below, the slide member 18 is naturally biased towards the open position by way of a spring member provided in the main body 12.

Referring to FIG. 3, when the locking handle 10 is mounted to a door 15, the handle 10 protrudes from the surface of the door so as to be gripped by a user to open the door 15. To assist a user in identifying the status of the locking handle 10, an indicator 14 is provided on the outer surface of the main body 12 to provide a visual indication as to whether the door is locked or unlocked. In this regard, the indicator 14 is in the form of a light member, such as an LED, that displays a green light to indicate that the door 15 is unlocked or a red light to indicate that the door is locked. It will also be appreciated that the status of the handle 10 will also provide a visual indication as to whether the door 5 is locked or unlocked due to the a user viewing whether the slide member 18 is retracted into the main body 12, or projecting from the main body 12. Such a dual means for visually identifying whether the door is locked or unlocked enables a user to readily identify the status of the door.

Figure 4:
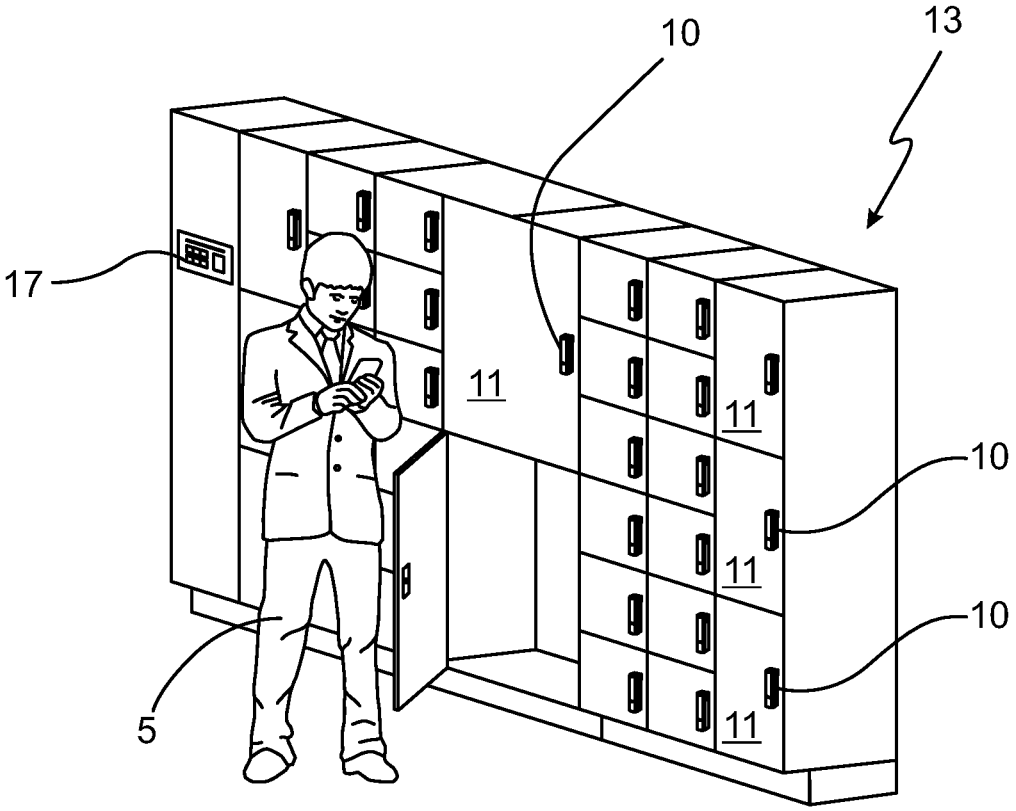
FIG. 4 shows a representative view of an embodiment for using the locking handles of the present invention.

Referring to FIG. 4, one manner in which the locking handle 10 of the present invention may be employed is shown. In this arrangement, the locking handles 10 are provided on individual lockers 11 provided in a bank of lockers 13. A control panel 17 is provided to facilitate central control of the locking handles 10 so as to open/close the doors of each locker 11 as required. In such an arrangement, the bank of lockers 13 may function as part of a delivery system whereby items are delivered to a locker for later collection by an individual 5.

As is shown, upon an item being delivered to a locker 11, an individual 5 is contacted by way of an email or sms message, indicating that an item is awaiting collection and providing a security code to collect the item. The individual then visits the bank of lockers 13 and enters the security code into the control panel 17, which may be in the form of a touch-panel computer screen. A controller then processes the code entered by the individual 5 and opens the associated locker 11 containing the item to be collected. This causes the visual indicator 14 on the handle 10 to activate to provide a visual indication of the locker 11 containing the item at which point the individual 5 is able to open the door of the locker 11 and retrieve the item for collection. Upon collection of the item, the individual 5 closes the door of the locker and pushes the slide member 18 into the main body 12 of the handle 10, thereby locking the locker 11. It will be appreciated that one or more sensors are provided in the main body 12 of the handle 10 to determine the state of the locking mechanism, with such data being sent to the controller and stored appropriately.

It will be appreciated that the embodiment shown in FIG. 4 and described above is merely indicative of one system in which the locking handles 10 of the present invention may be employed. Such a system takes advantage of the simple and robust construction of the handles 10 as is described above and which will be discussed in more detail below. However, it will be appreciated that locking handles 10 may be employed in a variety of applications and still fall within the spirit of the present invention.

The function of the locking handle 10 will be described below in relation to FIGS. 5-12.

Figure 5:
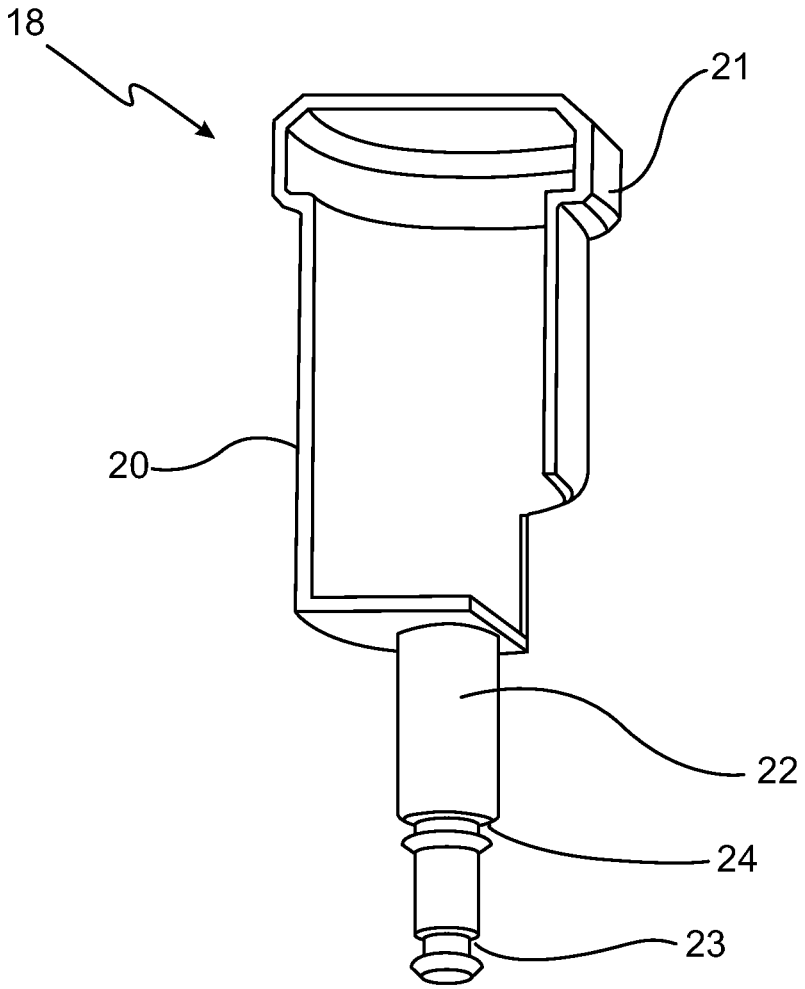
FIG. 5 is an isolated rear perspective view of a slide member of the locking handle in accordance with one embodiment of the present invention.

Referring to FIG. 5, a rear isolated view of one embodiment of the slide member 18 is shown. The slide member 18 comprises a barrel portion 20 that is slidingly received within the open end of the main body 12. The barrel portion 20 is substantially semi-circular in cross section and substantially conforms to the inner surface of the main body 12. A head portion 21 is provided on a distal end of the barrel portion 20 which has a width greater than that of the barrel portion 20 such that it is prevented from being inserted into the main body 12. A stud 22 extends from a proximal end of the barrel portion 20. The stud 22 is in the form of an elongate cylindrical projection that is configured to be received within an aperture provided in a fastener member provided in the main body 12. The stud has a retaining groove 23 formed adjacent the distal end thereof so as to retain the slide member 18 in contact with the main body 12, and a locking groove 24 is also provided so as to lock the slide member 18 in the closed position.

Figure 6:
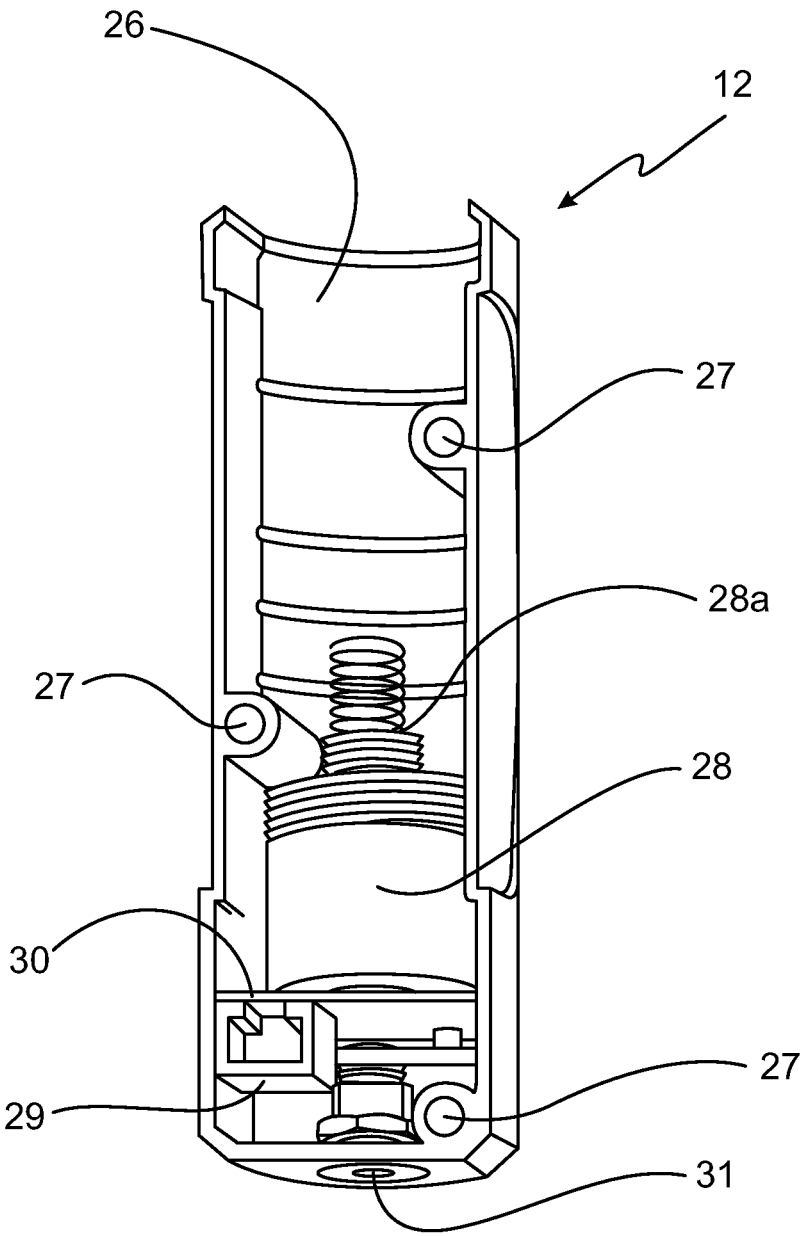
FIG. 6 is an isolated rear perspective view of a main body of the locking handle according to an embodiment of the present invention.

Referring to FIG. 6, a rear isolated view of the main body 12 is shown. The main body 12 is substantially semi-cylindrical and has a bore portion 26 into which is received the slide member 18. A number of locating holes 27 are provided in the main body 12 extending perpendicular to the bore 26. The locating holes 27 provide a means for securing the main body 12 to the surface of the door 15. As such, the holes 27 typically receive retaining screws or the like to secure the main body 12 in position.

A fastener member 28 is mounted within the main body 12. The fastener member 28 has an aperture 28*a* for receiving the stud 22 of the slide member 18. The fastening member 28 is of the type described and disclosed in the Applicant's co-pending International Patent Publication No. WO2006/105585 and International Patent Publication No. WO2004/001235, the contents of which are incorporated herein by reference.

In this regard, the fastening member 28 uses shape memory alloy wires or similar material adapted to contract when activated. The fastening member 28 may further include a shuttle (not shown) that is rotatable between a locking position, in which a locking means (not shown) engages the locking groove 24 of the stud, and an unlocking position in which the locking means does not engage the locking groove 24. In a preferred embodiment, the locking means is one or more teeth adapted to engage the locking groove 24.

During use of the locking handle 10, the shuttle is rotatable between a locking position wherein the teeth engage the locking groove 24, and an unlocking position in which the teeth do not engage the locking groove 24. The shuttle further incorporates means which engage the teeth in the locking position and which fail to engage the teeth or which move the teeth out of engagement with the locking groove 24 in the unlocking position. In a particularly preferred embodiment, the shuttle has one or more apertures into which the teeth are received in the unlocking position. When the teeth, are not in these apertures, the shuttle is designed to push the locking means into the locking groove 24 and hence to the locking position. The shuttle includes means adapted to engage the teeth and draw them out of engagement with the locking groove 24, when the shuttle is rotated to the unlocking position. The shuttle is rotatable by rotating means which includes material adapted to contract when activated. Preferably, this material is shape memory alloy wire and the shape memory alloy wire is wound around the shuttle which is rotatable within a body for the fastening member 28. The shape memory alloy wire is attached at one end to the shuttle and at the other to a non-rotatable part of the fastening member 28. When the shape memory alloy wire is caused to contract by the application of suitable energy to reach the necessary temperature, the shuttle rotates from the locking position to the unlocking position. A second shape memory alloy wire may be similarly connected to the shuttle in order to rotate it from the unlocking position to the locking position. It will be appreciated that the energy may be supplied to the fastening member 28 from an external controller, such as that described above in relation to the arrangement of FIG. 4.

Shape memory alloys are known and are usually made predominantly or wholly of titanium and nickel. They may also include other material, such as aluminium, zinc and copper. A shape memory alloy is capable of adopting one shape below a predetermined transition temperature and changing to a second shape once its temperature exceeds the transition temperature. Conversely, when the shape memory alloy cools below the transition temperature, it is capable of adopting the first shape again. Shape memory alloy wire currently available, such as that sold under the trade mark Nitinol, is capable of contracting by about 3 percent when activated by heating. Activation of the material adapted to contract when activated is preferably achieved through electrical resistance heating, with a wire feed to the assembly.

The fastening member 28 may also include a temperature sensor for sensing the temperature of the shape memory alloy wire. This can adjust the amount of energy applied to the shape memory alloy wire from the controller, depending on sensed temperature, to take into account varying conditions. For example, if the temperature is relatively low, a larger amount of power may need to be delivered to the shape memory alloy wire from the controller to heat it to the desired temperature. Conversely, if the temperature is high, the amount of power to be delivered to the shape memory alloy wire in order to cause it to contract may be far less. A temperature sensor can enable feedback and cause adjustment of power delivery in this regard.

It will be appreciated that the fastening member 28 of the invention may include lock status sensors, which can report whether the fastening member 28, and hence the locking handle 10, is in the locked or unlocked state. Such sensors may act as a reed switch, for example, so that when they make contact a report is generated that the fastener is in the locked or unlocked state, depending on the construction of the fastener. The lock status sensors may also work by enabling completion of an electrical circuit. Other configurations and means of sensing may also be applicable. It will be appreciated that signals generated by the sensors may be sent to an external controller, such as that described above in relation to the arrangement of FIG. 4 and are used to control the LEDs associated with the indicator 14 to provide a visual indication of the status of the locking handle 10.

Referring again to FIG. 6, the main body 12 includes a bias means, such as a spring 25 that biases the slide member 18 into the open position, as shown in FIG. 1. As such, when the fastening member 28 releases the stud 22, the stud is ejected under action of the spring 25.

The fastening member 28 is mounted within the main body 12 such that it is in electrical contact with circuit board 30. Circuit board 30 is preferably a daughterboard that receives operational signals from an external controller. A plug 29 is provided to facilitate electrical communication between the circuit board 30 and the external controller. In this arrangement, signals and power can be received from the external controller to operate the shape memory wires to control the fastening member 28 where appropriate. Similarly, the circuit board contains appropriate electronics to control the operation of the indicator 14 to provide visual indication of the status of the locking handle 10. Such a communication means also enables signals associated with one or more sensors to be communicated to the external controller where appropriate.

The main body also includes a manual release 31 to facilitate manual release of the fastening member 28. The manual release 31 is provided in the end of the main body and comprises a keyed entry for receiving a key to control the fastening member 31. In this regard, in the event of power or system failure, the door can be opened manually through use of a key.

Figure 7:
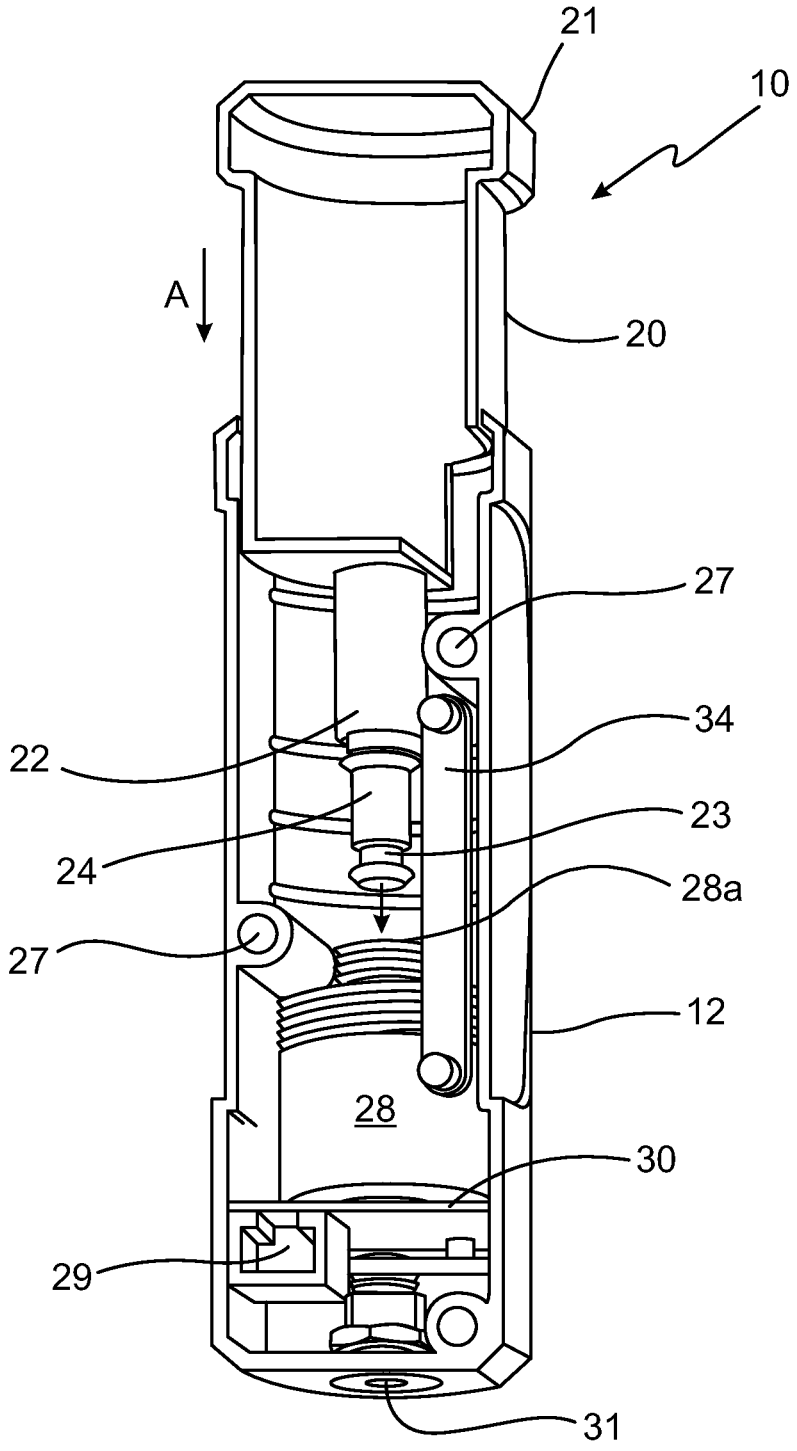
FIG. 7 is a rear perspective view of an embodiment of the present invention with the slide member of FIG. 5 and the main body of FIG. 6 assembled together.

Referring to FIG. 7, a rear view of the locking handle 10 is shown. In this arrangement, the slide member 18 is shown partially inserted into the main body 12. In order to assemble the handle 10, the slide member 18 is further inserted into the main body 12 such that the retaining groove is received and retained within the fastening member 28. Such an arrangement facilitates reciprocal motion of the slide member 18 within the main body 12 between an open position and a locked closed position. This motion can then be used to operate a locking mechanism of a door in a manner to be described below.

Upon fixing the locking handle 10 to a surface of a door, a recess is typically made in the door behind the locking handle 10, through which locking elements associated with the locking handle can pass. Such locking elements are able to engage with various existing locking mechanisms to provide motion to lock/unlock the door. Such motion is generated purely by the reciprocating motion of slide member 18 within the main body 12. It will be appreciated that such an arrangement may be used for single point as well as multi-point locking systems.

For doors 15 employing vertically sliding locking bars, the arrangement as shown in FIG. 7 is used. In this arrangement, a vertical member 34 is mounted to stud 22 of the slide member 18. A pair of pins 35 project from the member 34 so as to extend through a recess provided in the door behind the locking handle. The pins are able to engage with appropriately provided recesses formed in the vertical sliding locking bar. In this arrangement, reciprocal motion of the slide member 18 within the main body 12 is transferred directly to the vertical sliding locking bar. Hence, movement of the slide member 18 in the direction of arrow A (FIG. 7), namely from an open position to a locked or closed position, will result in the movement of the vertical sliding locking bar into a locked position preventing the door from being opened. The indicator 14 of the handle 10 will display that the door is locked and the door will not be able to be opened until the fastening member 28 receives an appropriate signal to release the stud 22 or until the fastening member 28 is manually released. Releasing the stud 22 will result in the slide member 18 returning to the opened position as shown in FIG. 1, under action of the biasing spring 25, thus causing movement of the vertical sliding locking bar into an unlocked position that enables the door 15 to be opened.

Figure 8:
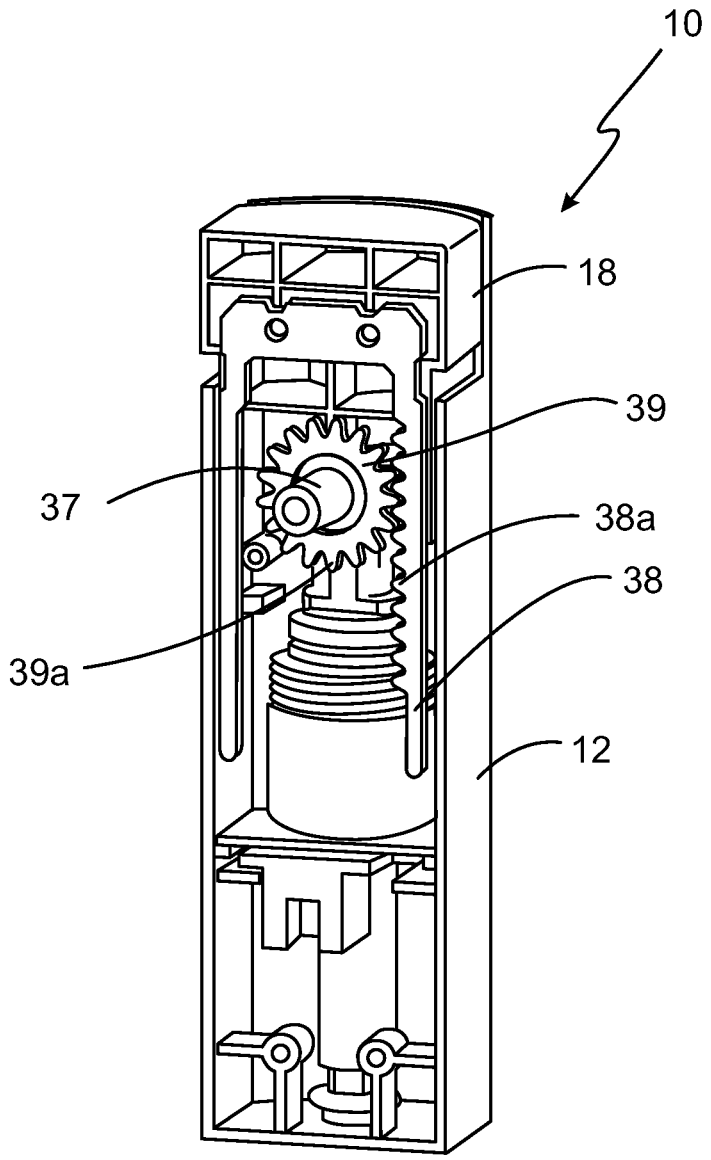
FIG. 8 is a rear perspective view of a locking handle according to one embodiment of the present invention employing a rack and pinion locking element.

Referring to FIG. 8, an alternative embodiment of the locking handle 10 is shown. In this embodiment, the handle 10 functions in substantially the same manner as described above, but employs a different locking element to that shown in FIG. 7. In this embodiment, a rack 38, in the form of a U-shaped rack, is mounted to the rear surface of the slide member 18. The rack 38 has a plurality of teeth 38*a* formed along a vertical arm thereof. The rack 38 is mounted such that reciprocal motion of the slide member 18 will result in reciprocal motion of the rack 38. A shaft 37 is mounted with respect to the main body 12, such that the position of the shaft with respect to the main body 12 is maintained constant, but the shaft 37 is free to rotate about its central axis. A pinion 39 is mounted on the shaft 37. The pinion 39 has a number of teeth or cogs 39*a* formed thereon which mesh with the teeth 38*a* of the rack 38. In this regard, reciprocal movement of the slide member 18 and rack 38 between the open and closed positions causes rotational movement of the pinion 39 thus causing the shaft 37 to rotate.

Figure 9:
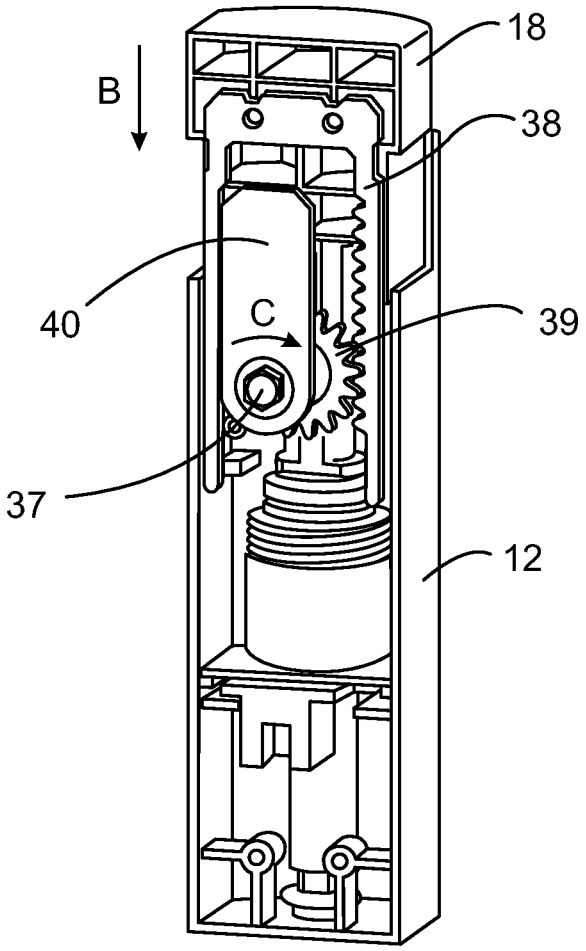
FIG. 9 is a rear perspective view of the locking handle of FIG. 8 in an open position.
Figure 10:
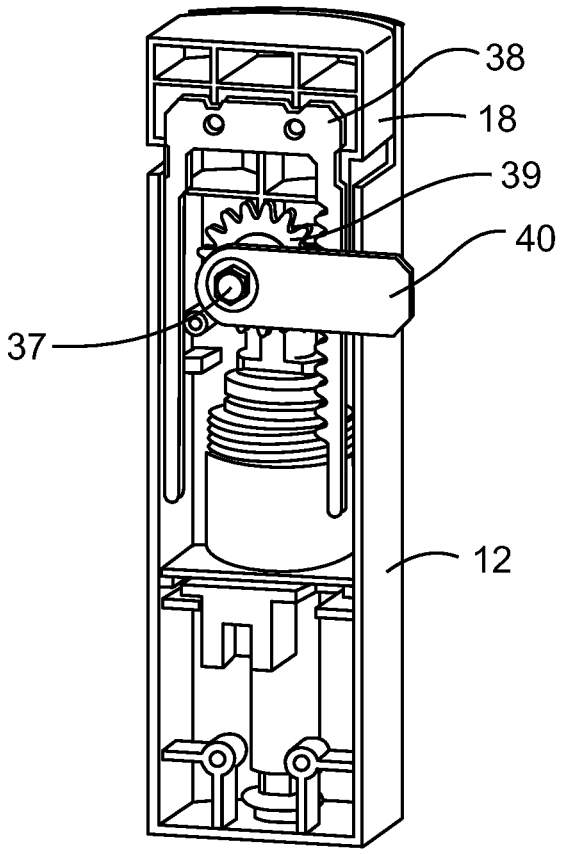
FIG. 10 is a rear perspective view of the locking handle of FIG. 18 in a closed position.

The shaft 37 projects sufficiently behind the handle 10 such that it can pass through a recess formed through the door. A locking tab 40 is then mounted to the distal end of the shaft 37 as is shown in FIGS. 9 and 10. Referring to FIG. 9, movement of the slide member 18 from the open position to the locked position in the direction of arrow B will result in rotation of the locking tab 40 in the direction of arrow C, namely from a vertical to a horizontal position, as is shown in FIG. 10. The locking tab 40 will then engage with a recess formed in the door jamb 41 to lock the door and prevent it from being opened. This is shown in FIG. 11.

Figure 11:
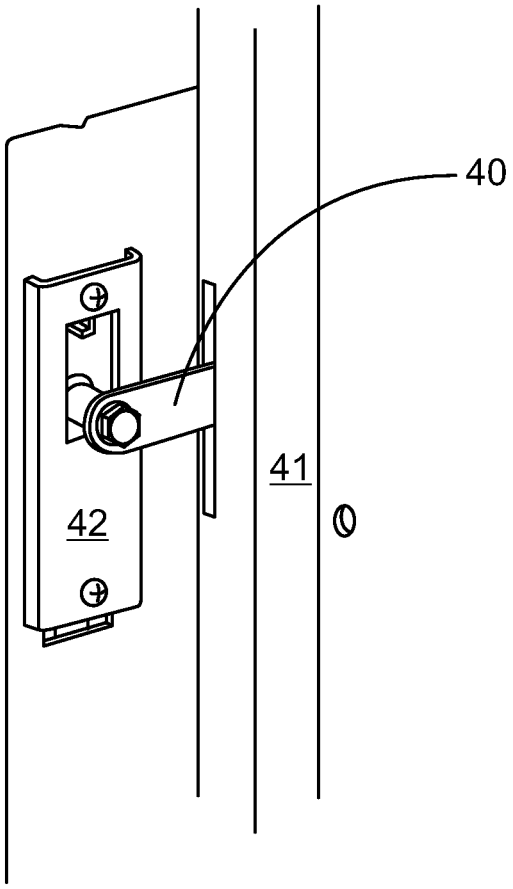
FIG. 11 is a rear view of the locking handle of FIG. 10 in use.

As is shown in FIG. 11, the present invention can be readily adapted to be used in pre-existing doors having a standard cut-out formed in the door. To enable such an adaptation, a backing plate 42 is mounted to the rear surface of the door to aid in securing the locking handle 10 in position on the front door surface.

In each of the embodiments of the present invention described above in relation to FIGS. 7-11, the locking handle has been employed in single point locking applications. However, it will be appreciated that the locking handle of the present invention may equally be employed in dual or multipoint locking application as will be discussed below.

Many three point locking systems employ standard mechanisms to lock a door along an edge thereof at the top and bottom of the door, as well as at a point midway between. Such systems are well known in the art and will not be described in further detail in the present application. In order to employ the present invention in such an arrangement the embodiment as discussed above in relation to FIGS. 8 to 10 is used.

Figure 12:
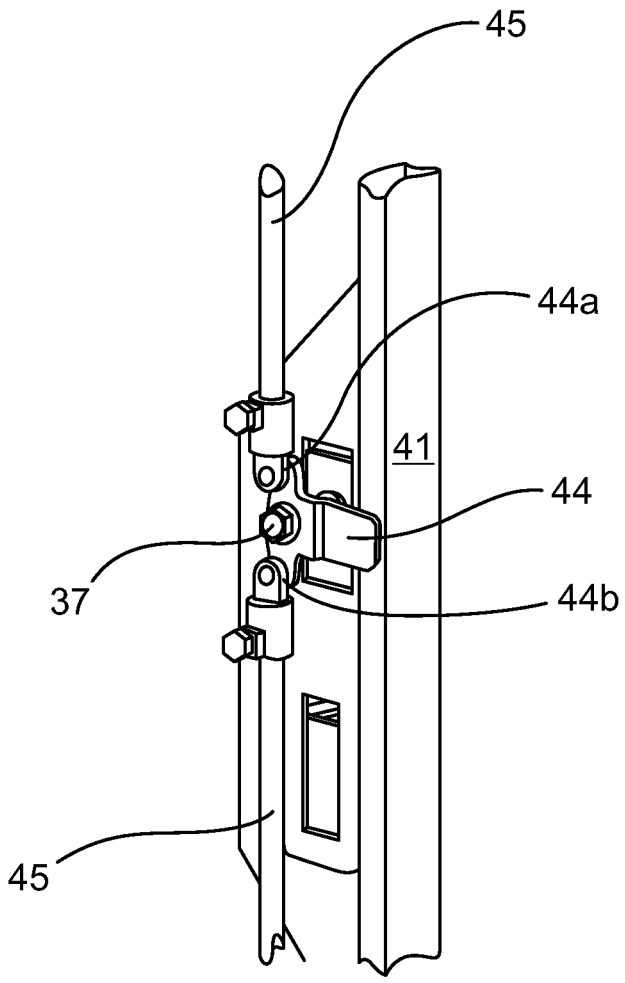
FIG. 12 is a rear view of an embodiment of the locking handle of the present invention in use in a multipoint locking arrangement.

As is shown in FIG. 12, a locking tab 44 is mounted to shaft 37 to engage with the door jamb 41. A pair of vertically sliding locking bars 45 are each connected to the locking tab at points 44*a* and 44*b* respectively to engage with the lintel and sill of the door respectively. In this arrangement, reciprocal motion of the slide member 18 within the main body 12 of the handle 10 causes rotation of the shaft 37. Such rotation causes the locking tab 44 to also rotate thereby move the locking tab 44 and vertical sliding locking bars 45 between a locking position and an unlocked position.

It will be appreciated that the handle of the present invention provides a simple and rugged device that enables secure locking of a door in a variety of applications. The door provides a simple pushing motion to facilitate locking/unlocking of the door and can be readily retrofitted to replace existing door handles and locking mechanisms. The handle of the present invention is mounted externally to the door and can be used with a variety of remote sensors and control systems in accordance with a variety of different applications.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

Orientational terms used in the specification and claims such as vertical, horizontal, top, bottom, upper and lower are to be interpreted as relational and are based on the premise that the component, item, article, apparatus, device or instrument will usually be considered in a particular orientation, typically with the handle uppermost.

It will be appreciated by those skilled in the art that many modifications and variations may be made to the methods of the invention described herein without departing from the spirit and scope of the invention.

INDUSTRIAL APPLICABILITY

As will be readily appreciated by those skilled in the various arts, the invention disclosed herein is not limited to the examples set out and has wide applications in many areas, representing significant advances in the relevant art. In particular, the invention provides a handle and locking mechanism which is far more sophisticated compared to prior art.

The invention claimed is:

1. A handle for a door closable within a door frame having a door corresponding door jamb, the handle comprising:

a body mountable to a surface of the door;

a slide member configured to be received at least partially within said body so as to slidingly move between a first position wherein the slide member projects beyond the body and a second position wherein the slide member is retracted into said body;

a fastening member mounted within said body so as to receive at least a portion of said slide member when the slide member is in the second position so as to lock said slide member in the second position; and a locking tab rotatable between a vertical position within the handle and a horizontal position extending outside the handle to engage with a recess formed in the door jamb; wherein sliding movement of said slide member from said first position to said second position rotates the locking tab via a rack and pinon arrangement to prevent opening of the door.

2. A handle according to claim 1, wherein the slide member comprises a stud portion that is received within an aperture of the fastening member when the slide member is in the second position.

3. A handle according to claim 2, wherein the fastening member has a shuttle that is rotatable to engage with a locking groove of the stud portion to lock the slide member in the second position.

4. A handle according to claim 3, wherein the shuttle is rotatable by material adapted to contract when activated.

* * * * *